United States Patent [19]

Cadwell

[11] Patent Number: 4,984,348

[45] Date of Patent: Jan. 15, 1991

[54] SUPERPLASTIC DRAPE FORMING

[75] Inventor: Gilbert C. Cadwell, Lakeside, Calif.

[73] Assignee: Rohr Industries, Inc., Chula Vista, Calif.

[21] Appl. No.: 492,314

[22] Filed: Mar. 6, 1990

Related U.S. Application Data

[63] Continuation of Ser. No. 297,108, Jan. 17, 1989, abandoned.

[51] Int. Cl.[5] ..... B23P 17/00

[52] U.S. Cl. ..... 29/423; 72/38; 72/60

[58] Field of Search ..... 29/423, DIG. 45; 72/38, 72/60, 342

[56] References Cited

U.S. PATENT DOCUMENTS 3,927,817 12/1975 Hamilton .
4,354,369 10/1982 Hamilton .
4,559,797 12/1985 Raymond .
4,584,860 4/1986 Leonard .

*Primary Examiner*—P. W. Echols
*Assistant Examiner*—I. Cuda
*Attorney, Agent, or Firm*—Patrick J. Schlesinger

[57] ABSTRACT

An improved method of superplastic forming comprises the steps of selecting a relatively larger driver sheet and a relatively smaller part blank, both being made of Titanium, Titanium alloy or other metal capable of exhibiting superplasticity. A ceramic die is placed on a bottom wall of an upwardly opening ceramic forming chamber having sidewalls with upper edges. The ceramic chamber has an outer supporting steel jacket. The part blank is positioned over the die. The driver sheet is positioned over the part blank so that the peripheral edges of the driver sheet rest on the upper edges of the sidewalls of the forming chamber. A cover is provided for closing the chamber. It has a peripheral seal extending from an underside thereof. The cover and the chamber are clamped together in order to impinge the seal into a periphery of the driver sheet. The driver sheet and part blank are then heated to a predetermined temperature at which they exhibit superplasticity. Next a pressurized inert gas is introduced into an interior formed by the closed cover and chamber and thereafter released so that the driver sheet presses and forms the part blank around the die. The peripheral edges of the part blank are free to draw in during the forming to thereby avoid any undesired necking or thinning. The cover is lifted from the chamber and the formed driver sheet and part blank are removed.

28 Claims, 2 Drawing Sheets

SUPERPLASTIC DRAPE FORMING

This is a continuation of copending application Ser. No. 07/297,108 filed on Jan. 17, 1989 now abandoned.

BACKGROUND OF THE INVENTION

The present invention relates to forming metal parts, and in particular, to an improved method of forming Titanium part blanks over dies under superplastic conditions in order to avoid thinning or necking in the formed parts.

For many years it has been known that certain metals, such as Titanium, as well as certain metal alloys, exhibit superplasticity within limited temperature ranges and strain rates. Superplasticity is the capability of a material to develop unusually high tensile elongations with a reduced tendency towards necking. Thus when in a superplastic condition, the metal or metal alloy exhibits low resistance to deformation and may be elongated with controlled thinning. This permits a sheet of such metal to be readily formed against dies to achieve desired shapes. Superplastic forming (SPF) may be performed in conjunction with diffusion bonding. Diffusion bonding refers to metallurgical joining of surfaces of similar or dissimilar metals by holding them in physical contact and applying heat and pressure sufficient to cause commingling of the atoms at the junction. Further details of both SPF and diffusion bonding may be had by way of reference to U.S. Pat. No. 3,934,441 of Hamilton et al. entitled "Controlled Environment Superplastic Forming of Metals" and U.S. Pat. No. 3,927,817 of Hamilton et al. entitled "Method of Making Metallic Sandwich Structures".

Figs. 1*a* and 1*b* illustrate an older conventional technique of SPF which is known as diaphragm forming. Referring to Fig. 1*a*, a relatively large sheet of Titanium 10 is laid horizontally across an upwardly opening steel forming chamber 12. The chamber is supported in a hydraulic press (not shown) so that a steel cover 14 can be closed against the chamber from above. The peripheral edges of the Titanium sheet are firmly clamped between the mating edges: the forming chamber and cover which has a peripheral seal (not visible). The sheet is then heated to the appropriate temperature and formed around a ceramic die 16 supported in the forming chamber as illustrated in Fig. 1*b*. This formation results from the introduction of pressurized Argon gas on both sides of the sheet and the subsequent release of pressurized gas on the lower side of the sheet. See for example U.S. Pat. No. 3,974,673 of Fosness et al. entitled "Titanium Parts Manufacturing" wherein a smaller radiation shield 64 is also draped over the sheet directly above the die.

The diaphragm forming approach is not compatible with dies having relatively large vertical dimensions. This is because thinning of the sheet in proportion to the amount and depth of forming is inherent. The peripheral seal prevents inward slippage of the sheet edges and thinning of the sheet occurs where large deformations are necessary, resulting in weak points in the formed part. With such dies uniform thicknesses could be achieved if the edges of the metal sheet were horizontally drawn in to accommodate substantial downward stretching of the sheet. However, if the seal is eliminated and the clamp pressure is lessened so that sheet can slide between the cover and chamber, it is not possible to maintain the desired gas pressures.

FIGS. 2*a* and 2*b* illustrate a newer technique of SPF I developed which is known as drape forming. It has been used successfully on a commercial basis for several years to form parts around dies that extend substantial distances in a direction normal to the initial plane of the Titanium sheet so that there is little or no thinning or necking. A relatively smaller Titanium sheet 18 which is the part blank is positioned directly over the die 16 and is driven against and around the die by the overlying relatively larger driver sheet 10. The edges of the part blank 18 are free to pull inwardly to thereby alleviate any thinning that would otherwise occur. Typically a Boron Nitride powder is used to facilitate sliding contact between the underside of the part blank 18 and the outer surface of the ceramic die 16. See for example U.S. Pat. No. 4,269,053 of Agrawal et al. entitled "Method of Superplastic Forming Using Release Coatings with Different Coefficients of Friction". A similar release compound may also be used between the driver sheet and part blank to reduce friction therebetween.

In the drape forming approach, the part blank may be tack or spot welded to the driver sheet at appropriate locations when both are still flat in order to maintain the proper positioning of the part blank over the die during the SPF process. The positions of the welds are chosen so that they do not inhibit drawing in of the edges of the part blank as necessary to prevent thinning. Alternatively, the flat part blank may be cut to provide arms which extend therefrom and contact the side walls to hold the part blank in position over the die during the SPF process. Such positioning arms may also be separate pieces spot welded to the part blank. The driver sheet may be made of Titanium or mild steel, and where the former is utilized, it may be less expensive low grade or reject Titanium sheet which itself cannot be used to form an aircraft part. The part blank may be formed with tabs to provide a gripping surface to aid in separating the formed part from the complementary formed driver sheet. One formed driver sheet can be used as an apply template to designate part trim and hole locations, for all subsequent parts.

Heretofore the forming chamber which has been used in drape forming has been made entirely of steel. Because of the high temperatures involved in SPF, e.g. 1600–1700 degrees F., the bottom wall of the steel chamber has had a tendency to bow, which sometimes results in fracturing of the ceramic die supported thereon. The chamber must be made of Chrome-Nickel steel to withstand the high temperatures, but still it ends up having a limited life. Replacing the chamber is both time consuming and costly. Also, the steel chamber has relatively thick walls, and therefore a relatively large mass. This mass is heated by resistance type electric heaters in the SPF press. The outer walls of the steel chamber are thermally insulated with a water cooled jacket. Nevertheless, each time the press is opened a tremendous amount of heat is lost, resulting in substantial additional electric power being consumed in order to maintain the high temperatures required.

SUMMARY OF THE INVENTION

It is therefore the primary object of the present invention to provide an improved method of SPF that maintains a substantially uniform thickness in parts formed against ceramic dies having relatively large dimensions normal to the metal sheet while at the same time minimizing breakage of the dies and reducing power consumption.

The preferred embodiment of my improved method of superplastic forming comprises the following steps. First, a relatively larger driver sheet and a relatively smaller part blank are selected. Both the driver sheet and-the part blank are made of titanium, titanium alloy or other metal capable of exhibiting superplasticity. A ceramic die is placed on a bottom wall of an upwardly opening ceramic or metal forming chamber having sidewalls with upper edges. The ceramic chamber has an outer supporting steel jacket. The part blank is positioned over the die. The driver sheet is positioned over the part blank so that the peripheral edges of the driver sheet rest on the upper edges of the sidewalls of the forming chamber. It will be understood that prior to placing the driver sheet over the chamber, the part blank may be spot welded to the underside thereof. Alternatively, positioning arms may be provided, either as an integral part of the part blank, or spot welded thereto, which will engage the sidewalls of the chamber for maintaining the position of the part blank over the die. A steel cover is provided for closing the chamber. It has a peripheral seal extending from an underside thereof. The chamber and the cover are preferably supported in a press and the cover is opened and closed by a hydraulic ram, pneumatic diaphragm or some other suitable drive mechanism. The cover and the chamber are clamped together in order to impinge the seal into a periphery of the driver sheet. The driver sheet and part blank are then heated to a predetermined temperature at which they exhibit superplasticity. The heating is preferably solely via resistance type radiant heaters supported within a ceramic upper platen attached to the cover. Next a pressurized inert gas is introduced into an interior formed by the closed cover and chamber and thereafter released so that the driver sheet presses and forms the part blank around the die. The peripheral edges of the part blank are free to draw in during the forming to thereby avoid any undesired necking or thinning. The cover is lifted from the chamber and the formed driver sheet and part blank are removed.

Because a ceramic chamber is used, the chances of the die being fractured or broken when the chamber and die are subjected to high temperatures and pressures is effectively eliminated. The bottom wall of the ceramic chamber will not warp as in the case of prior steel chambers. The forming chamber has substantially less steel than prior forming chambers. Heaters are only used in the upper platen from which the steel cover is suspended. Therefore less heat is radiated from the chamber, particularly since the inner ceramic chamber portion acts as a thermal insulator to some degree. Accordingly expensive water cooled jackets are not necessary and electric power consumption is substantially reduced.

DESCRIPTION OF THE PREFERRED EMBODIMENT

Figure 1A:
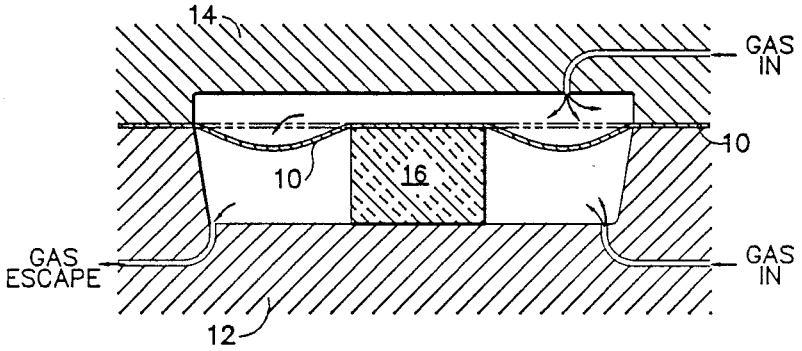
Figs. 1*a* and 1*b* are simplified vertical sectional views illustrating the sequential steps of an SPF technique which is known as diaphragm forming.
Figure 1B:
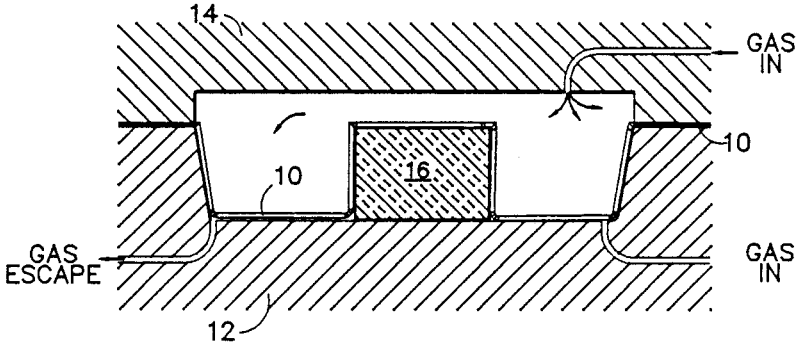
Figure 2A:
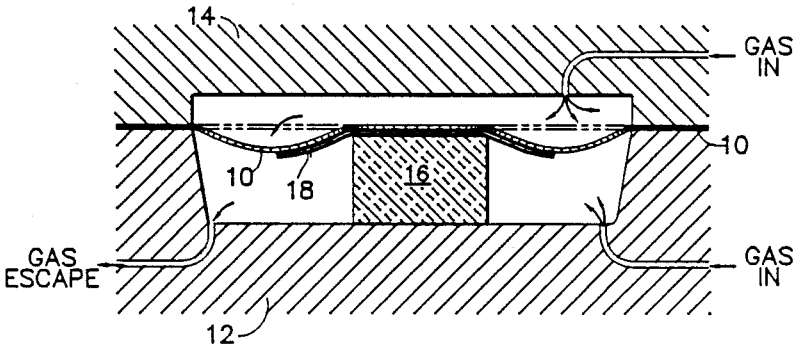
FIGS. 2*a* and 2*b* are simplified vertical sectional views illustrating the sequential steps of an SPF technique which is known as drape forming.
Figure 2B:
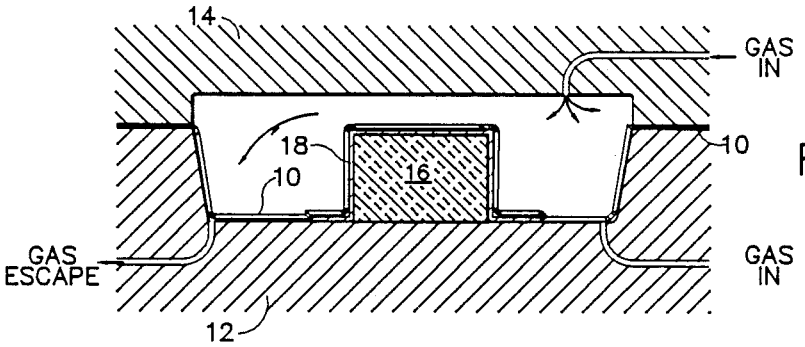
Figure 3:
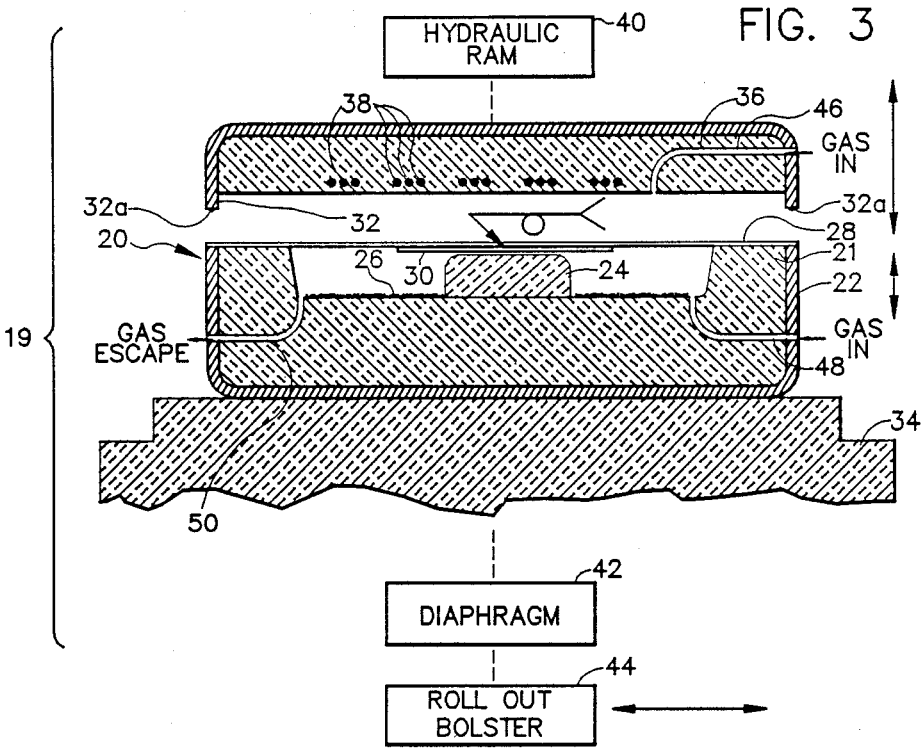
FIG. 3 is a simplified vertical sectional/diagrammatic view of a press illustrating a preferred embodiment of the improved drape forming method of the present invention.

Referring to FIG. 3, according to my invention an SPF press 19 has a cold wall forming chamber 20 with an inner, upwardly opening ceramic portion 21 that is surrounded and supported by an outer steel jacket portion 22. The ceramic portion has great compressive strength and may consist, for example, of Calcium-Aluminate binder and fused Silica aggregate. The surrounding metal portion may be made of mild steel which supplies the great tensile strength lacking in the ceramic portion. Together the ceramic portion 21 and surrounding steel jacket 22 form a pressure vessel.

A ceramic die 24 is supported on the upper side of the bottom wall of the ceramic chamber portion 21 and may be held in position by suitable granular filler illustrated diagrammatically by stippling 26. The die 24 has a substantial vertical height and has sharp radii. A relatively larger Titanium driver sheet 28 is laid horizontally across the forming chamber 20 so that its peripheral edges overlie the upper horizontal edges of the sidewalls of the ceramic and steel portions 21 and 22. A relatively smaller Titanium part blank 30 is spot welded to the underside of the driver sheet 28 as indicated by the drafting symbol

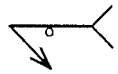

at suitable locations before it is placed over the chamber 20. The driver sheet 28 and the part blank 30 may be made of Titanium, Titanium alloy or other metal capable of exhibiting superplasticity.

Boron Nitride powder or some other suitable lubricant compound is applied over the upper surface of the die 24 for producing a low coefficient of friction between the part blank 30 and the die 24 during the forming process. The compound must be one that has a negligible affinity for Titanium under high temperature and pressure conditions so that the purity and strength thereof is not degraded. Similarly Boron Nitride powder or some other suitable releasing agent is applied to the upper side of the part blank 30 so that the same can be readily pulled from the driver sheet 28 once both have been conformably shaped and removed from the press.

A steel cover 32 is provided for covering the opening of the forming chamber 20. The cover has a peripheral seal indicated at 32*a* which impinges into the peripheral edges of the driver sheet 28 when the cover is clamped against the forming chamber 20. The seal may take the form of a bead formed on the periphery of the underside of the steel cover 32.

The forming chamber 20 is supported on a lower ceramic platen 34. The cover 32 surrounds and supports an upper ceramic platen 36 having embedded therein coils 38 for radiant heating of the Titanium sheets to a temperature in the range of 1600–1700 degrees F. The coils may comprise Kanthal or comparable heating elements 0.30" in diameter, with a 30 Watts per square inch heating density, and located in cores formed in the upper ceramic platen 36.

The cover 32 and the upper ceramic platen 36 are mechanically coupled to a conventional hydraulic ram assembly 40 supported by an upper bolster (not shown) for closing the cover 32 with the chamber 20 therebeneath and for thereafter raising the cover to open the chamber. A hydraulic ram assembly need not be used. Instead, the lower ceramic platen 34 may be moved upwardly and downwardly via inflation and deflation of a diaphragm 42 mechanically coupled thereto. Once the driver and part blank are loaded into the press, the hydraulic ram assembly or diaphragm closes the cover against the driver sheet with sufficient force to overcome the forming pressure. The closing force is also sufficient to impinge the pressure seal into the Titanium driver sheet in order to provide a gas impervious seal. It will be noted that the seal 32*a* pushes against portions of the driver sheet 28 which are directly above the upper edges of the steel jacket portion 22 of the forming chamber. Where a diaphragm is used, it may be connected to a source of pressurized gas (not shown) sufficient to provide substantial clamping pressure, e.g. 550 tons.

The lower platen 34 and diaphragm 42 are supported by a lower roll out bolster 44 which may slide horizontally on air bearings or other rolling means on the support frame of the press (not illustrated). When the upper platen and cover are opened, the forming chamber may be slid laterally out from thereunder for ease of loading or unloading of the parts, as indicated by the horizontal arrow in FIG. 3. Thus the formed driver and part blank can be removed and new unformed sheets installed, before the chamber is slid back under the cover and upper platen.

A passage 46 through the upper ceramic platen 36 and cover 32 permits a suitable inert pressurized gas such as Argon from a source not shown to be introduced above the upper side of the driver sheet 28 once the same is clamped between the cover and the forming chamber. Another passage 48 through the forming chamber 20 similarly permits pressurized Argon gas to be introduced into the interior of the chamber below the lower side of the driver sheet 28. Another passage 50 through the forming chamber 20 is provided for the gradual release of pressurized Argon gas from the interior formed between the chamber and the cover under the control of suitable valve means not illustrated.

According to my improved drape forming method, the press is first closed and the heater coils 38 are energized so that the chamber temperature will stabilized at a predetermined temperature between about 1600 and 1700 degrees F. Thermocouples and regulator circuits may be utilized as is well known. The chamber is purged with Argon gas for five to ten minutes. The cover 32 is then raised, and the forming chamber 20 is rolled out via bolster 44. The ceramic die 24 has previously been positioned as desired on the bottom of the ceramic chamber portion 21 and the filler 26 introduced to maintain the die in position. Prior to their installation in the press, suitable lubricating agents and releasing agents are applied over the die and over the upper side of the part blank. The part blank 30 is spot welded to the driver sheet 28 so that when the driver sheet is placed in position over the forming chamber, the part blank is directly over the die 24. The part blank is sized so that when it is formed and its edges drawn in, they will be close to where they should be for the finished part, thereby minimizing the amount of costly Titanium to be trimmed away.

The next step is to roll the forming chamber back under the cover and to close the cover via the hydraulic ram assembly or diaphragm. The driver sheet and part blank are allowed to heat up for a time sufficient to achieve a superplastic state. Concurrently with heat up, the chamber is again purged with Argon gas for five minutes. Next the sealing force is applied. Both sides of the driver sheet are then pressurized to approximately 100–300 PSI. Forming is then begun by gradually bleeding off pressure on the die side while maintaining pressure on the upper side of the driver sheet. When there is no longer any pressure on the die side, the part blank is formed. To form sharp radii into the part blank, it may be necessary to hold the pressure on the upper side for a long period of time, e.g. thirty minutes. While the driver sheet is pushing the part blank down around the contour of the die 24, the edges of the part blank are free to be drawn inwardly, thereby avoiding any undesirable thinning of the part. It will be understood that because the die 24 sits on the ceramic chamber portion, the chances of the die being fractured or broken when the chamber and die are subjected to high temperatures and pressures in effectively eliminated. The bottom wall of the ceramic chamber portion 21 will not warp as in the case of prior steel chambers.

Once the part blank is formed, all Argon gas pressure is released, the diaphragm is deflated, and the hydraulic ram assembly opened. The forming chamber is rolled out. An operator, using tongs, pries the formed and joined driver sheet and part blank away from the die. Alternatively, a part ejector may be used. The formed part blank is then pulled apart from the driver sheet. The formed driver sheet can then be used as an apply template to designate part trim and hole locations, on all subsequent parts.

The forming chamber 20 has substantially less steel than prior forming chambers. Heaters are only used in the upper platen. Therefore less heat is radiated from the chamber, particularly since, to a certain extent, the inner ceramic chamber portion 21 acts as a thermal insulator. Accordingly expensive water cooled jackets are not necessary and electric power consumption is substantially reduced.

Figure 4:
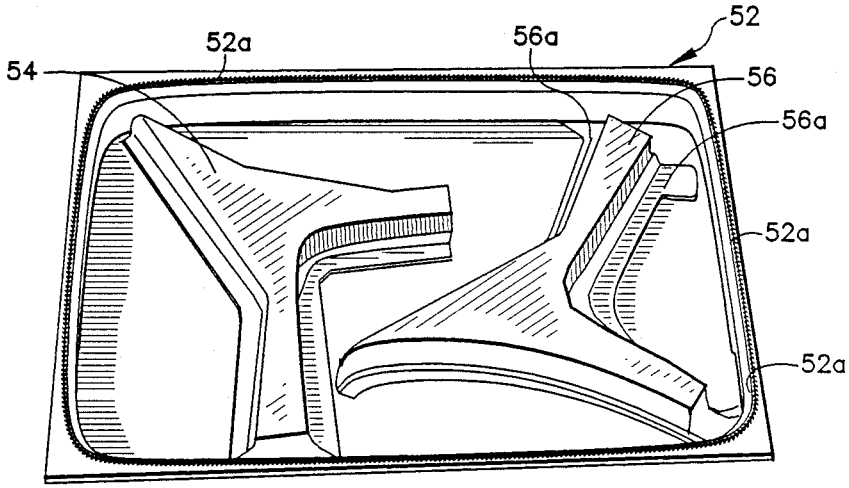
FIG. 4 is a perspective view of a driver sheet formed over a pair of generally Y-shaped part blanks in accordance with the method of the present invention.

FIG. 4 is a perspective view of a Titanium driver sheet 52 which has been formed over a pair of generally Y-shaped part blanks 54 and 56 and underlying ceramic dies in accordance with the method of the present invention. The part blanks themselves are not visible but the impressions that they have formed in the overlying driver sheet are visible in this drawing figure. Each part blank is formed over a corresponding ceramic die, there being a pair of dies which have been removed from the hollow interiors of the formed part blanks. The part blank 56 has positioning arms 56*a* which are an integral portion thereof and extend therefrom. The ends of these arms 56*a*initially contact the sidewalls of the forming chamber to hold the part blank 56 in position over its corresponding ceramic die. Again only the impressions of these arms are visible. As the part blank forms, the ends of the positioning arms pull in from the sides of the forming chamber. The impression 52*a* which is formed in the side edges of the driver sheet by the peripheral seal on the underside of the cover is illustrated at 52*a*. The formed part blanks are popped out of the formed driver sheet once it has cooled. They can then be trimmed and machined as necessary. In the illustrated example, the Y-shaped formed parts are struts for the nacelle of a commercial airliner.

While I have described a preferred embodiment of my drape forming method, it should be understood that modifications and adaptations thereof will occur to persons skilled in the art. In the preferred embodiment of my method the sheets are Titanium, however alloys of Titanium and Nickel alloys as well as other metals and metal alloys may be similarly formed under superplastic conditions and therefore the term "metal capable of exhibiting superplasticity" should be understood to include the same. Also, while in the preferred embodiment the part blank is spot welded to the driver sheet, it will be understood that the part blank could instead be provided with positioning arms, in which case it will simply be inserted into the forming chamber above the die with the ends of the arms touching the side walls of the forming chamber. In an actual run, one to twelve parts were formed per cycle. Therefore, the protection afforded my invention should only be limited in accordance with the scope of the following claims.

I claim:

1. A method of superplastic forming comprising the steps of:

selecting a relatively larger driver sheet and a relatively smaller part blank, both the driver sheet and the part blank being made of a metal capable of exhibiting superplasticity;

placing an independent ceramic die on a bottom wall of an upwardly opening ceramic forming chamber having side walls with upper edges, the die being spaced from the side walls of the forming chamber;

positioning the part blank over the die;

positioning the driver sheet over the part blank so that the peripheral edges of the driver sheet rest on the upper edges of the sidewalls of the forming chamber;

providing a cover for closing the chamber, the cover having a peripheral seal extending from an underside thereof and having an upper ceramic platen connected to the upper side thereof;

pressing the cover against the driver sheet via a hydraulic ram mechanically coupled to the cover to impinge the seal into a periphery of the driver sheet;

allowing the driver sheet and part blank to be heated to a predetermined temperature at which they exhibit superplasticity, said heating being performed via radiant heaters mounted in said upper ceramic platen connected to the upper side of said cover;

introducing a pressurized gas into an interior formed by the closed cover and chamber and thereafter releasing the pressurized gas so that the driver sheet presses and forms the part blank around the die;

lifting the cover and removing the formed driver sheet and part blank; and rolling the ceramic forming chamber out from under the cover following the pressure releasing step via a roll-out bolster positioned below said forming chamber.

2. A method according to claim 1 and further comprising the step of separating the formed driver sheet and part blank.

3. A method according to claim 1 wherein the part blank is selected from the group consisting of Titanium and Titanium alloy.

4. A method according to claim 1 wherein the predetermined temperature is between about 1600 and 1700 degrees F. and the gas pressure is between about 100 and 300 PSI.

5. A method according to claim 1 wherein the gas is introduced both above and below the driver sheet.

6. A method according to claim 1 wherein the gas is Argon.

7. A method according to claim 1 wherein the ceramic forming chamber is surrounded by a supporting metal jacket.

8. A method according to claim 7 wherein the metal jacket is made of mild steel.

9. A method according to claim 1 wherein the gas is first pressurized on both sides of the driver sheet, and then gradually released from the underside of the driver sheet.

10. A method according to claim 1 wherein the part blank is spot welded to an underside of the driver sheet.

11. A method according to claim 1 wherein the part blank is provided with positioning arms which extend therefrom and contact the sidewalls of the chamber to maintain the part blank in position over the die.

12. A method according to claim 1 wherein the part blank is provided with tabs which extends from a periphery thereof and which may be gripped to pull the formed part blank from the formed driver sheet.

13. A method according to claim 1 wherein a lubricant compound is applied over the surface of the die.

14. A method according to claim 1 wherein a release agent compound is applied between the driver sheet and the part blank.

15. A method of superplastic forming comprising the steps of:

selecting a relatively larger driver sheet and a relatively smaller part blank, both the driver sheet and the part blank being made of a metal capable of exhibiting superplasticity;

placing an independent ceramic die on a bottom wall of an upwardly opening ceramic forming chamber having side walls with upper edges, the die being spaced from the side walls of the forming chamber;

positioning the part blank over the die;

positioning the driver sheet over the part blank so that the peripheral edges of the driver sheet rest on the upper edges of the sidewalls of the forming chamber;

providing a cover for closing the chamber, the cover having a peripheral seal extending from an underside thereof;

pressing the cover against the driver sheet using a diaphragm positioned below the forming chamber to impinge the seal into a periphery of the driver sheet;

allowing the driver sheet and part blank to be heated to a predetermined temperature at which they exhibit superplasticity, said heating being performed via radiant heaters mounted in said upper ceramic platen connected to the upper side of said cover;

introducing a pressurized gas into an interior formed by the closed cover and chamber and thereafter releasing the pressurized gas so that the driver sheet presses and forms the part blank around the die;

lifting the cover and removing the formed driver sheet and part blank; and rolling the ceramic forming chamber out from under the cover following the pressure releasing step via a roll-out bolster positioned below said forming chamber.

16. A method according to claim 15 and further comprising the step of separating the formed driver sheet and part blank.

17. A method according to claim 15 wherein the part blank is selected from the group consisting of Titanium and Titanium alloy.

18. A method according to claim 15 wherein the predetermined temperature is between about 1600 and 1700 degrees F. and the gas pressure is between about 100 and 300 PSI.

19. A method according to claim 15 wherein the gas is introduced both above and below the driver sheet.

20. A method according to claim 15 wherein the gas is Argon.

21. A method according to claim 15 wherein the ceramic forming chamber is surrounded by a supporting metal jacket.

22. A method according to claim 15 wherein the metal jacket is made of mild steel.

23. A method according to claim 15 wherein the gas is first pressurized on both sides of the driver sheet, and then gradually released from the underside of the driver sheet.

24. A method according to claim 15 wherein the part blank is spot welded to an underside of the driver sheet.

25. A method according to claim 15 wherein the part blank is provided with positioning arms which extend therefrom and contact the sidewalls of the chamber to maintain the part blank in position over the die.

26. A method according to claim 15 wherein the part blank is provided with tabs which extends from a periphery thereof and which may be gripped to pull the formed part blank from the formed driver sheet.

27. A method according to claim 15 wherein a lubricant compound is applied over the surface of the die.

28. A method according to claim 15 wherein a release agent compound is applied between the driver sheet and the part blank.

* * * * *